US012522409B2

(12) United States Patent
Fransen et al.

(10) Patent No.: US 12,522,409 B2
(45) Date of Patent: Jan. 13, 2026

(54) CONTAINER

(71) Applicant: NICONOVUM AB, Malmö (SE)

(72) Inventors: Nelly Fransen, Malmö (SE); Salih Muhammed, Malmö (SE)

(73) Assignee: NICONOVUM AB, Malmo (SE)

( * ) Notice: Subject to any disclaimer, the term of this patent is extended or adjusted under 35 U.S.C. 154(b) by 346 days.

(21) Appl. No.: 18/020,295

(22) PCT Filed: Jun. 21, 2021

(86) PCT No.: PCT/EP2021/066872
§ 371 (c)(1),
(2) Date: Feb. 8, 2023

(87) PCT Pub. No.: WO2022/033752
PCT Pub. Date: Feb. 17, 2022

(65) Prior Publication Data

US 2023/0286708 A1 Sep. 14, 2023

(30) Foreign Application Priority Data

Aug. 12, 2020 (GB) ..... 2012571

(51) Int. Cl.
*B65D 50/04* (2006.01)
*B65D 43/02* (2006.01)

(52) U.S. Cl.
CPC ..... *B65D 50/046* (2013.01); *B65D 43/0231* (2013.01); *B65D 2215/02* (2013.01)

(58) Field of Classification Search
CPC ..... B65D 50/046; B65D 43/0231; B65D 2215/02; B65D 2209/00; B65D 21/0228
See application file for complete search history.

(56) References Cited

U.S. PATENT DOCUMENTS 1,534,871 A 4/1925 Roystone
1,845,315 A * 2/1932 Meikle ..... A46B 9/04 15/160

(Continued)

FOREIGN PATENT DOCUMENTS

CA 174798 S 8/2018
JP 2009254429 A 11/2009

(Continued)

OTHER PUBLICATIONS

International Search Report for corresponding application PCT/EP2021/066872 filed Jun. 21, 2021; Mail date Sep. 30, 2021.

(Continued)

*Primary Examiner* — James N Smalley
(74) *Attorney, Agent, or Firm* — CANTOR COLBURN LLP

(57) ABSTRACT

A container comprising a base defining a primary storage compartment; a lid having a peripheral wall that locates over a first portion of the base to close the primary storage compartment; and a cover having a peripheral lip that locates over a second portion of the base so that the base and the cover together define a secondary storage compartment, is disclosed. The primary storage compartment is closed by the lid and the cover is received on the base with the peripheral wall of the lid and the peripheral lip of the cover extending towards each other.

18 Claims, 2 Drawing Sheets

(56) References Cited

U.S. PATENT DOCUMENTS

| | | | | | |
|---|---|---|---|---|---|
| 2,204,784 | A * | 6/1940 | Abrams | B65D 81/32 D28/91 |
| 2,533,159 | A * | 12/1950 | Yates | B65D 43/0222 220/799 |
| 3,360,153 | A * | 12/1967 | Wheaton, Jr. | A47J 36/06 220/256.1 |
| 4,165,815 | A | 8/1979 | Vetter | |
| 4,196,808 | A * | 4/1980 | Pardo | B65D 55/00 222/129 |
| 4,484,682 | A * | 11/1984 | Crow | A45C 13/00 220/636 |
| 4,913,299 | A * | 4/1990 | Petro | B29C 45/262 215/216 |
| 5,058,754 | A * | 10/1991 | Hickerson | B65D 50/04 215/221 |
| D514,936 | S | 2/2006 | Pace | |
| D711,249 | S | 8/2014 | Henriksson | |
| 8,939,310 | B1 | 1/2015 | Stravitz | |
| 9,687,094 | B2 * | 6/2017 | Farmer | A47G 19/23 |
| 2008/0035646 | A1 | 2/2008 | Smith | |
| 2009/0084795 | A1 | 4/2009 | Kagen | |
| 2010/0078341 | A1 | 4/2010 | Rasmussen | |
| 2019/0174822 | A1 | 6/2019 | Bjoerkholm | |
| 2020/0037729 | A1 | 2/2020 | Reid | |

FOREIGN PATENT DOCUMENTS

| | | | |
|---|---|---|---|
| KR | 20180041634 | A | 4/2018 |
| WO | 2017208154 | A1 | 12/2017 |

OTHER PUBLICATIONS

Written Opinion for corresponding application PCT/EP2021/066872 filed Jun. 21, 2021; Mail date Sep. 30, 2021.

* cited by examiner

CONTAINER

FIELD OF THE INVENTION

The present invention relates to a container. The container may contain a consumer product such as a tobacco pouch or a medicinal product such as medicinal chewing gum, medicinal patch or medicinal pouch.

BACKGROUND TO THE INVENTION

Containers comprising two compartments in a back-to-back orientation are known. The first compartment may contain a consumer product, such as a plurality of pouches, to be used by a consumer. The pouches may contain tobacco or a substance related to the tobacco industry. Alternatively, the pouches may be tobacco-free but contain a substance related to nicotine replacement therapy. The second compartment may be used to store the consumer product once it has been used by a consumer before disposal, and/or for storing a product information leaflet on which information relating to the product is provided. Each of the compartments is closed by a separate lid, at least the lid closing a primary storage compartment in which the consumer product is contained prior to consumption may form part of a child-resistant closure that requires manipulation by an adult to allow removal.

SUMMARY OF THE INVENTION

According to an aspect of the invention, there is provided a container comprising a base defining a primary storage compartment, a lid having a peripheral wall that locates over a first portion of the base to close the primary storage compartment and a cover having a peripheral lip that locates over a second portion of the base so that the base and the cover together define a secondary storage compartment. When the primary storage compartment is closed by the lid and the cover is received on the base, the peripheral wall of the lid and the peripheral lip of the cover extend towards each other.

The peripheral lip of the cover may be offset from the peripheral wall of the lid in a direction extending away from the base.

The second portion of the base may comprise a flange protruding outwardly from the first portion of the base.

The flange may extend laterally beyond the peripheral wall of the lid when the lid is in a closed position on the base, the peripheral wall of the lid having an end face that contacts a surface of the flange when the lid is located on the base.

Preferably, the base may comprise a dividing wall between the first and second portions of the base that separates the base into primary and secondary storage compartments.

The flange may be a lateral extension of the dividing wall.

The flange may have a peripheral rim that depends from the surface of the flange in a direction away from the first portion of the base.

The peripheral rim may define a shallow recessed region in the base together with the dividing wall and the flange, said shallow recessed region may form the secondary storage compartment together with the cover.

The cover may locate on the flange such that the peripheral lip of the cover overlies the peripheral rim of the flange.

The cover may have a major face from which the peripheral lip upstands, a recess being formed in said major face.

The peripheral rim of the flange may include a plurality of protuberances equidistantly spaced around said edge.

The peripheral lip of the cover may comprise a plurality of recesses positioned and shaped to correspond with the position of said protuberances, such that each protuberance on the peripheral rim may be received in a corresponding recess in the peripheral lip when the cover is located on the flange.

The container may comprise four protuberances on the peripheral rim of the flange and four corresponding recesses on the peripheral lip of the cover.

The cover may comprise a locking tab that extends inwardly from the peripheral lip of the cover and locates on the surface of the flange when the cover is in a closed position on the base.

The end face of the peripheral wall of the lid may contact a surface of the locking tab and the surface of the flange when the lid is located on the base.

The flange may comprise a pocket formed in the surface of the flange to receive the locking tab on the cover. A surface of the locking tab and a surface of the flange may be flush with each other when the locking tab is received in the pocket. If the locking tab is compressible, then it may be flush with the surface of the flange when the lid is received on the base and the lid compresses the locking tab.

The cover may be pivotally attached to the base by a hinge. In this case, the locking tab may comprise a radially inwardly directed tongue spaced from the hinge.

The locking tab may comprise at least two inwardly directed tongues spaced from each other around the peripheral lip of the cover.

The tongue or tongues may be resiliently flexible and deform to enable the cover to be released from the base once the lid has been partially released.

The cover may be an interference fit over the flange.

The cover may be made from a flexible material.

The lid may be coupled to the first portion of the base with a child-proof closure.

DETAILED DESCRIPTION

Figure 1:
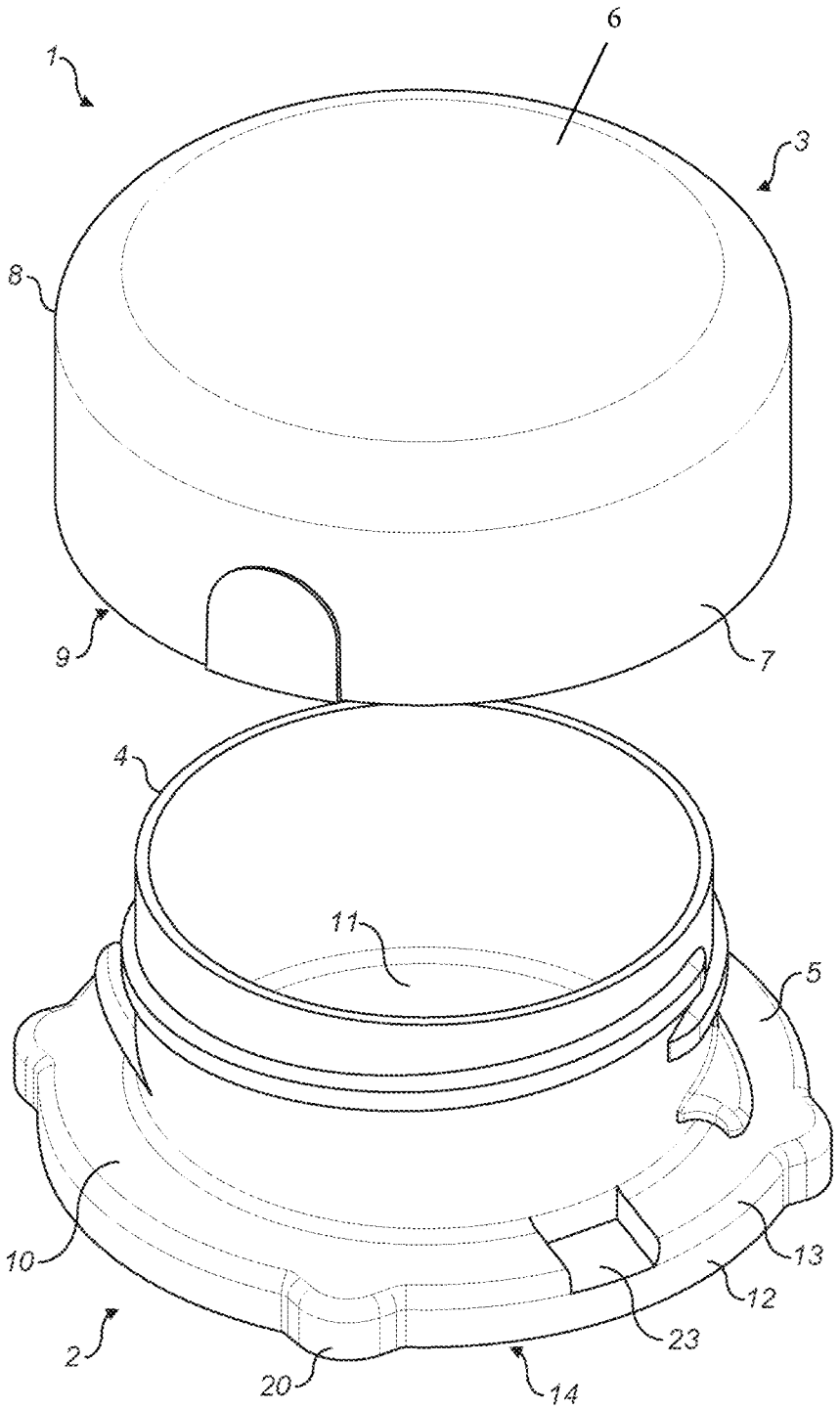
FIG. 1 illustrates an isometric view of a base and a lid of a container according to an embodiment of the invention.

FIG. 1 illustrates a base 2 and a lid 3 of a container 1 according to an embodiment of the invention. The base 2 comprises a first portion 4 and a second portion 5. The first 35 portion 4 is a substantially cylindrical portion which defines a primary storage compartment. The second portion 5 is a flange that protrudes outwardly from the first portion 4. The lid 3 comprises a lid major face 6, that is substantially cylindrical, and a peripheral wall 7 depending from an edge 8 of said lid major face 6.

In preferred embodiments, the lid 3 is removably attached to the base 2, however it is to be appreciated that the lid 3 may be hinged to the base 2 or attached in an alternative manner. As seen in FIG. 1, the lid 3 is removably attached to the base. When the lid 3 is received on the base 2, the peripheral wall 7 of the lid 3 locates over the first portion 4 of the base 2 to close the primary storage space and the second portion 5 of the base 2 (the flange 5) extends laterally beyond the peripheral wall 7 of the lid 3. An end face 9 of the peripheral wall 7 of the lid 3 is in direct face-sharing contact with a top surface 10 of the flange 5 when the lid 3 is in a closed position on the base 2 to form a fully enclosed primary storage space to contain a consumer product. The lid 3 and base 2 may be attached by any suitable locking mechanism. In the embodiment illustrated in FIG. 1 the lid 3 is attached to the first portion 4 of the base 2 by a screw mechanism and a child-proof closure. The child-proof closure must be released before the user is able to release the lid 3 from the first portion 4 of the base 2.

The base 2 further comprises a dividing wall 11 located at the bottom of the first portion 4 of the base 2. The flange 5 is an extension of said dividing wall 11 and comprises a peripheral rim 12 that depends from an edge 13 of the flange 5 in a direction away from the first portion 4 of the base 2. The peripheral rim 12 defines a shallow recessed region 14 in the underside of the base 2. A secondary storage compartment is located underneath the base 2 and is defined by the dividing wall 11, the flange 5 and the shallow recessed region 14. The dividing wall 11 separates the first storage compartment from the second storage compartment.

Figure 2:
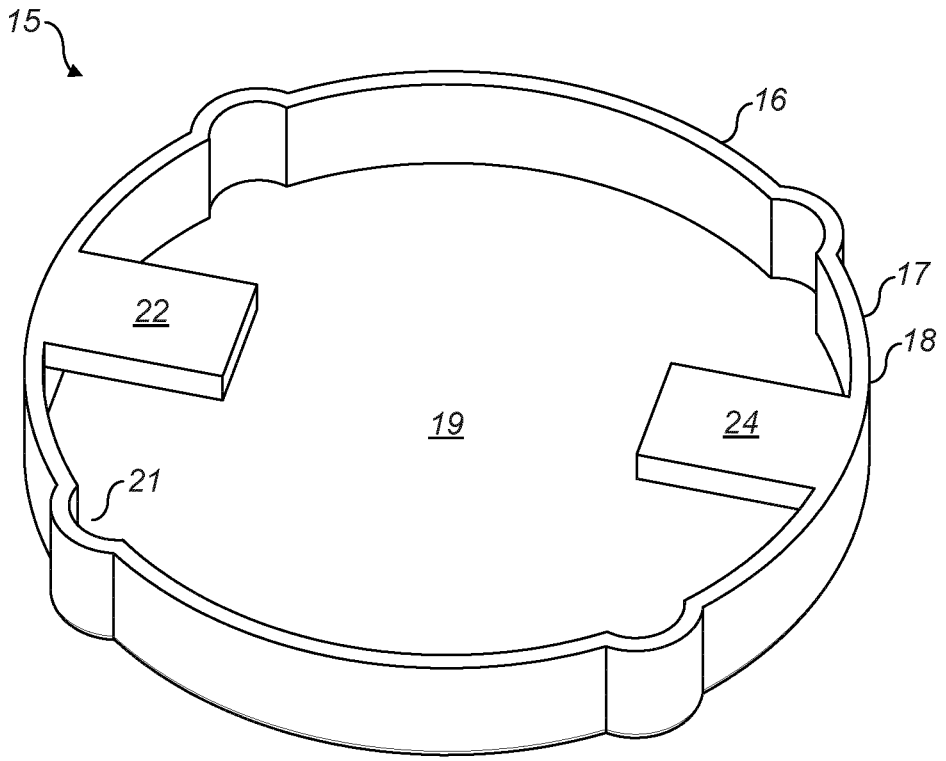
FIG. 2 illustrates an isometric view of a cover of a container according to an embodiment of the invention.

The container 1 according to an embodiment of the invention further comprises a cover 15. The cover 15, as illustrated in FIG. 2, comprises a substantially cylindrical cover major face 16 and a peripheral lip 17 which depends from an edge 18 of the cover major face 16, forming a recess 19 in said cover major face 16. In preferred embodiments, the cover 15 is removably attached to the base 2, however it is to be appreciated that the cover 15 may be hinged to the base 2 or attached in an alternative manner. The cover 15 is attached to the second portion 5 of the base 2 (the flange 5) in such a way that the peripheral lip 17 of the cover 15 locates over the second portion 5 of the base 2 and overlies the peripheral rim 12 of the flange 5 via an interference fit and thus closes the secondary storage compartment. When both the lid 3 and the cover 15 are in a closed position on the base 2, the peripheral wall 7 of the lid 3 and the peripheral lip 17 of the cover 15 extend towards each other from the respective major faces 6, 16 (i.e. they are opposite to each other). Additionally, the peripheral lip 17 of the cover 15 is offset from the peripheral wall 7 of the lid 3 in a direction extending away from the base 2, this allows a user to grip the peripheral wall 7 to easily remove the cover 15. The secondary storage compartment may provide a space to receive and store a printed information leaflet and/or be used to contain used product. The cover 15 may be recessed or dished to increase the amount of space formed by the secondary storage compartment.

In preferred embodiments, as illustrated in FIG. 1, the second portion 5 of the base 2 (the flange 5) comprises a number of protuberances 20 equidistantly spaced around the peripheral rim 12 of the flange 5. In the embodiment shown, the peripheral rim 12 of the flange 5 comprises four equidistantly spaced protuberances 20, however, the peripheral rim 12 of the flange 5 may comprises any suitable number of protuberances 20. The protuberances 20 are substantially semi-circular or arcuate in shape, however, the protuberances 20 may take the form of any shape or size. As seen in FIG. 2, the peripheral lip 17 of the cover 15 comprises a number of equidistantly spaced recesses 21, positioned and shaped to correspond with the protuberances 20 of the peripheral rim 12 of the flange 5. These recesses 21 are of identical shape and size to the protuberances 20 such that when the cover 15 is in a closed position on the base 2, each of the protuberances 20 on the peripheral rim 12 of the flange 5 is received within a corresponding recess 21 on the peripheral lip 17 of the cover 15.

In certain embodiments, the cover 15 may further comprise a locking tab 22 which extends inwardly from the peripheral lip 17 of the cover 15. As seen in the FIG. 2, the locking tab 22 may comprises two tongues 22 directly opposite from one another that are substantially rectangular in shape. It is to be appreciated that the locking tab 22 may comprise any number of tongues 22 formed in any suitable shape or size. The locking tab 22 is configured to contact the top surface 10 of the flange 5 when the cover 15 is in a closed position on the base 2. The flange 5 comprises a pocket 23 in the top surface 10 of the flange 5 configured to receive the locking tab 22 when the cover 15 is in a closed position on the base 2. The pocket 23 is designed to be the same shape and size as the locking tab 22. When the locking tab 22 is received within the pocket 23, a top surface 24 of the locking tab 22 and the top surface 10 of the flange 5 are flush with each other. Therefore, when the lid 3 is in a closed position on the base 2, the end face 9 of the peripheral wall 7 of the lid 3 contacts the top surface 10 of the flange 5 and the top surface 24 of the locking tab 22. The tongues 22 are made from a resiliently flexible material and are configured to deform to enable the cover 15 to be released from the base 2 when the lid 3 is partially released from the base 2.

It will be appreciated that, in the embodiment in which the cover 15 has locking tabs 22, it is not possible to remove the cover 15 from the base 2 until the lid 3 has been removed or opened, or until at least the lid 3 has been partially released from the base. Only once the lid has at least been partially released is it possible for the locking tabs on the cover 15 to be released from their corresponding pockets 23 to allow removal of the cover 15. Partial release of the cover 15 may include release of the child-resistant closure.

In embodiments in which the cover 15 is permanently attached to the base 2, i.e. by a hinge, it will be understood that the locking tab 22 may comprise only a single tongue that engages in a single pocket 23 in the flange 5. The tongue may be located diametrically opposite to the hinge.

The container 1 is preferably made from plastic such as HDPE or the like. The cover 15 may be integrally formed with the container 1 and therefore may be also made from HDPE or the like. Alternatively, the cover 15 may be separately manufactured from the container 1 and formed from other plastics such as LDPE etc. The lid 3 may be formed of a different material to the base 2, such as polypropylene.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A container comprising:

a base comprising a first portion defining a primary storage compartment and a second portion comprising a flange protruding outwardly from the first portion, the flange comprising a top surface and a peripheral rim depending from an edge of the top surface of the flange in a direction away from the first portion;

a lid having a peripheral wall comprising an end face, wherein the peripheral wall locates over the first portion of the base such that when the lid is located on the base to close the primary storage compartment, the end face of the lid contacts the top surface of the flange of the second portion between the first portion of the base and the peripheral rim of the flange; and a cover that locates over the second portion to define a secondary storage compartment; the cover having a peripheral lip that overlies the peripheral rim of the flange such that the peripheral wall of the lid and the peripheral lip of the cover extend towards each other;

wherein the peripheral lip of the cover is outwardly spaced from the peripheral wall of the lid in a direction extending along the top surface of the flange.

2. A container according to claim 1, wherein the base comprises a dividing wall between the first and second portions of the base that separates the base into primary and secondary storage compartments.

3. A container according to claim 2, wherein the flange is a lateral extension of the dividing wall.

4. A container according to claim 1, wherein the peripheral rim defines a shallow recessed region in the base together with the dividing wall and the flange, said shallow recessed region forming the secondary storage compartment together with the cover.

5. A container according to claim 3, wherein the cover has a major face from which the peripheral lip upstands, a recess being formed in said major face.

6. A container according to claim 1, wherein the peripheral rim of the flange includes a plurality of protuberances equidistantly spaced around said edge.

7. A container according to claim 6, wherein the peripheral lip of the cover comprises a plurality of recesses positioned and shaped to correspond with the position of said protuberances, such that each protuberance on the peripheral rim is received in a corresponding recess in the peripheral lip when the cover is located on the flange.

8. A container according to claim 7, comprising four protuberances on the peripheral rim of the flange and four corresponding recesses on the peripheral lip of the cover.

9. A container according to claim 1, wherein the cover comprises a locking tab that extends inwardly from the peripheral lip of the cover and locates on the surface of the flange when the cover is in a closed position on the base.

10. A container according to claim 9, wherein the end face of the peripheral wall of the lid contacts a surface of the locking tab and the surface of the flange when the lid is located on the base.

11. A container according to claim 10, wherein the flange comprises a pocket formed in the surface of the flange to receive the locking tab on the cover.

12. A container according to claim 11, wherein a surface of the locking tab and a surface of the flange are flush with each other when the locking tab is received in the pocket.

13. A container according to claim 9, wherein the cover is pivotally attached to the base by a hinge and the locking tab comprises a radially inwardly directed tongue spaced from the hinge.

14. A container according to claim 11, wherein the cover is removably attached to the base and the locking tab comprises at least two inwardly directed tongues spaced from each other around the peripheral lip of the cover.

15. A container according to claim 12, wherein the or each tongue are resiliently flexible and deform to enable the cover to be released from the base once the lid has been partially released.

16. A container according to claim 1, wherein the cover is an interference fit over the flange.

17. A container according to claim 1, wherein the cover is made from a flexible material.

18. A container according to claim 1, wherein the container comprises a child-proof closure for coupling the first portion of the base to the lid.

* * * * *